US007707798B1

(12) United States Patent
Cullinan

(10) Patent No.: US 7,707,798 B1
(45) **Date of Patent: *May 4, 2010**

(54) SCREENING DEVICE

(76) Inventor: James E. Cullinan, 4988 Thornhill La., Dublin, OH (US) 43017

( * ) Notice: Subject to any disclaimer, the term of this patent is extended or adjusted under 35 U.S.C. 154(b) by 1049 days.

This patent is subject to a terminal disclaimer.

(21) Appl. No.: 11/358,485

(22) Filed: Feb. 20, 2006

(51) Int. Cl.
*E04B 1/343* (2006.01)
*E04B 1/62* (2006.01)

(52) U.S. Cl. ..... 52/780; 52/507; 52/506.06; 52/656.2; 52/72; 52/656.1

(58) Field of Classification Search ..... 52/770, 52/781, 780, 200, 507, 510, 656.1, 72, 800.12, 52/656.2, 656.7, 506.06
See application file for complete search history.

(56) References Cited

U.S. PATENT DOCUMENTS

| | | | | |
|---|---|---|---|---|
| 1,158,626 | A | 11/1915 | Brooks | |
| 1,220,219 | A | 3/1917 | Goldman | |
| 1,460,098 | A | 6/1923 | Houser | |
| 1,589,560 | A | 6/1926 | Reuter | |
| 2,177,699 | A | 10/1939 | Fisher | |
| 2,302,047 | A | 11/1942 | Olsen | |
| 2,817,752 | A | 12/1957 | Florence | |
| 3,106,269 | A | 10/1963 | Revell et al. | |
| 3,507,079 | A | 4/1970 | George | |
| 3,525,560 | A | 8/1970 | Gasner et al. | |
| 3,606,510 | A | 9/1971 | Anderson | |
| 3,720,432 | A | 3/1973 | Chudler | |
| 3,742,659 | A | 7/1973 | Drew | |
| 3,802,131 | A | 4/1974 | Research | |
| 3,890,989 | A | 6/1975 | Kuxhouse et al. | |
| 3,975,881 | A * | 8/1976 | Ninowski, Jr. | 52/775 |
| 4,001,985 | A | 1/1977 | Niklolaus et al. | |
| 4,044,518 | A | 8/1977 | Hodge | |
| 4,179,169 | A | 12/1979 | Daniels et al. | |
| 4,263,763 | A | 4/1981 | Bouwens | |
| 4,488,565 | A | 12/1984 | Smith | |

(Continued)

FOREIGN PATENT DOCUMENTS

| | | |
|---|---|---|
| GB | 2 043 148 A | 10/1980 |

(Continued)

OTHER PUBLICATIONS

Spinnaker Rooftop Screening System, date unknown.

*Primary Examiner*—Richard E Chilcot, Jr.
*Assistant Examiner*—Mark R Wendell
(74) *Attorney, Agent, or Firm*—Jason H. Foster; Kremblas & Foster

(57) ABSTRACT

A screening device is provided with multiple channel upper and lower panel retaining members that allow multiple panels to be laterally moved past each other. Channel end caps, a panel rolling member assembly and close spacing of the upper and lower panel retaining members prevent removal of the panels from the screening device. A support structure uses angled castings and extrusion members for rapid custom screen device assembly that avoids long welding assembly times as well as subsequent weld failure due to screen device vibration. The panel rolling member assembly uses balls, rollers or wheels to easily move the panels in their channels. A trim member with oppositely faced channels engages upper and lower projections on the panel retaining members and covers fastener heads located in a recess in the panel retaining members.

16 Claims, 7 Drawing Sheets

U.S. PATENT DOCUMENTS

| | | | | | |
|---|---|---|---|---|---|
| 4,498,262 | A | | 2/1985 | Garcia | |
| 4,541,208 | A | | 9/1985 | Vesperman et al. | |
| 4,550,534 | A | | 11/1985 | Mariano et al. | |
| 4,769,965 | A | | 9/1988 | Shaub | |
| 4,884,379 | A | | 12/1989 | McCabe | |
| 5,007,214 | A | * | 4/1991 | Itami et al. | 52/66 |
| 5,062,243 | A | * | 11/1991 | Kumagai | 52/66 |
| 5,117,594 | A | * | 6/1992 | Muramoto et al. | 52/66 |
| 5,470,139 | A | | 11/1995 | Hsiao | |
| 5,568,707 | A | | 10/1996 | Ishikawa et al. | |
| 5,647,181 | A | | 7/1997 | Hunts | |
| 5,664,384 | A | | 9/1997 | Cullinan | |
| 5,797,225 | A | | 8/1998 | Ishikawa | |
| 5,997,117 | A | | 12/1999 | Krietzman | |
| 6,209,271 | B1 | | 4/2001 | Kovacs | |
| 6,401,427 | B1 | * | 6/2002 | Snyder | 52/764 |
| 6,428,127 | B1 | | 8/2002 | Rasmussen | |
| 6,647,683 | B1 | | 11/2003 | Thomsen et al. | |
| 6,923,238 | B2 | * | 8/2005 | Kern et al. | 160/197 |
| 7,000,362 | B1 | | 2/2006 | Cullinan | |
| 2002/0023726 | A1 | * | 2/2002 | Davis et al. | 160/87 |
| 2005/0028949 | A1 | * | 2/2005 | Winner | 160/371 |
| 2006/0032156 | A1 | * | 2/2006 | Simard | 52/66 |

FOREIGN PATENT DOCUMENTS

| | | | |
|---|---|---|---|
| GB | 2 124 689 | A | 2/1984 |
| GB | 2 151 462 | A | 7/1985 |

* cited by examiner

SCREENING DEVICE

FIELD

This invention relates to screening devices and related types of apparatus. It has to do primarily with apparatus for screening the view of large outdoor equipment where it is necessary or desirable to improve its appearance in public places. For example, the invention can provide attractive screening for heating, ventilating, and air conditioning equipment on top of business establishments in areas of a city where all outdoor structures are required to have a pleasing appearance. In particular this invention relates to an improved screen device in which sheets are slidably contained within upper and lower tracks and secured within the tracks by permanently attached end caps.

BACKGROUND

As set forth in U.S. Pat. No. 5,664,384, screening apparatus for large equipment can be difficult and time consuming to remove when it is necessary to make repairs or adjustments unless the screening apparatus is constructed and arranged so that it can be moved easily from its normal location around the equipment. In that patent, the screening apparatus was designed so that panels could be moved quickly and easily away from, and back to, their normal screening location by a single person without need for equipment to move the screening apparatus. Unfortunately, it has been found that on occasion severe weather conditions would force the panels from their securing tracks. And even more perversely, it has been found that individuals repairing the screened equipment often removed the panels and then failed to replace them after the repairs had been completed.

In addition to the problem of "lost" panels, members of the framework supporting the panels and the channels in which they were mounted were typically welded together. This of course required extensive and exact setup prior to and during the welding process. Further, due to the vibration of the underlying equipment to which the screen was mounted, welds were found to be subject to breakage with subsequent deleterious consequences to the screen panels. Further it has been observed that sliding panels, i.e., panels that slide in lower channels are often difficult to move due to dirt and other debris that may accumulate in the lower channels. Also the alignment and fastening of decorative trim panels to the panel retainers can be a time consuming and tedious process and removal can be difficult if fasteners become corroded and difficult to remove.

In order to overcome these problems, it is an object of the present invention to provide a framework that is easy to assemble.

It is another object of the present invention to provide a framework that is adjustable with only a minimum of assembler effort.

It is another object of the present invention to provide a framework that avoids weld breakage.

It is yet another object of the present invention to provide covering panels (sheets) that afford easy access to the underlying machinery.

It is another object of the present invention to provide covering panels that are incapable of being removed from their tracks.

It is another object of the present invention to provide covering panels capable of accepting user indicia.

It is another object of the present invention to provide covering panels that are easily moveable within their mounting channels.

It is another object of the present invention to provide a rapid and easy method of attaching trim panels to the panel retainer.

Another object of the present invention is to provide a method of protecting fasteners from rust and corrosion.

It is therefore the main purpose of the present invention to provide quick and easy access to the screened unit while preventing loss of the screening sheets and providing an attractive appearance at all other times with an assembly that is easy to assemble and which avoids breakage due to severe machinery vibration.

The foregoing and other objects, features and advantages of the invention will become apparent from the following disclosure in which one or more preferred embodiments of the invention are described in detail and illustrated in the accompanying drawings. It is contemplated that variations in procedures, structural features and arrangement of parts may appear to a person skilled in the art without departing from the scope of or sacrificing any of the advantages of the invention.

SUMMARY

These and other objects are met by the present invention of a screening device as shown generally in FIG. 1 and which comprises two or more panels 40, an upper, rigid, elongate and substantially channel shaped top panel retaining member 20 that is held in an upper lengthwise horizontal position, a bottom panel retaining member 30 that is parallel to the top panel retaining member 20, and a corner member 50 (FIG. 4 and especially FIG. 14) that prevents the panels 40 from being removed from the top and bottom panel retaining members 20 and 30, respectively.

Referring specifically to FIG. 14, the screening device comprises 1) at least two panels 40, each having a pair of parallel opposite edges and 2) a panel assembly that holds panels 40 at a predetermined location. The panel assembly comprises a framework including: 1) an upper rigid elongate substantially channel shaped top panel retaining member 20" held in an upper lengthwise horizontal position with at least two, spaced-apart upper channels 22" and 24" facing substantially downward, and 2) a lower rigid elongate substantially channel shaped bottom panel retaining member 30" held in a lower lengthwise horizontal position with at least two, spaced-apart lower channels 32" and 34"being parallel to, and facing substantially upward toward the top panel retaining member 20".

The upper channels 22" and 24" are spaced apart sufficiently from each other and the lower channels 32" and 34" are spaced apart sufficiently from each other to allow for unobstructed passage of panels 40 with respect to each other on lateral movement of panels 40 in the spaced-apart upper and lower channels, 22" and 24" and 32" and 34", respectively. An end cap 50' is positioned over the ends of at least one of the spaced-apart upper channels 22" and 24" and spaced-apart lower channels 32" and 34" to prevent panels 40 from being removed from the upper channels and lower channels by lateral movement of panels 40 in the upper and lower channels.

A corner supporting structure 160 comprises: 1) a vertical corner member 64, 2) two lower horizontal members 82, each with first and second ends, with the horizontal members attached at right angles to each other at their first end portions to a lower portion of the vertical corner member 64, 3) two vertical angular support members 86, each with first and second ends, with the vertical angular support members 86 attached at their lower first end portions to said second end portions of the horizontal members 82 and at their upper end portions to an upper portion of the vertical corner member 64, and 4) a horizontal corner member 84 attached at its end portions to the second end portions of the two horizontal members 82. A panel rolling member assembly 310 (see also FIG. 15) allows panels 40 to roll in the upper channels 22" and 24" of top panel retaining member 20" or in the lower channels 32" and 34" of lower panel retaining member 30".

The screening device 300 can also comprise two upper horizontal members 182, each with first and second end portions, with the horizontal members 182 attached at right angles to each other at their first end portions to an upper portion of vertical corner member 64. The top panel retaining member 20" is attached to one of the two upper horizontal members 182 and the bottom panel retaining member 30" is attached to one of the two lower horizontal members 82. A horizontal corner member 186 can be attached to the second end portions of the two upper horizontal members 182. Vertical members 184 are attached to the second end portion of one of the two upper horizontal members 182 and to the second end portion of one of the two lower horizontal members 82.

As seen in the cut-away section 15 of FIG. 14 and in detail in FIGS. 15 and 16, a panel rolling member assembly 310 is attached to panel 40. As seen in FIGS. 16-19, the panel rolling member assembly 310 can be attached to the top panel retaining member 20'" (FIG. 17) or 20" (FIG. 18) or to the bottom panel retaining member 30'" (FIG. 19). The panel rolling member assembly 310 comprises a rolling member that can be selected from the group of rolling members consisting of balls 316 (FIG. 18), rollers 318 (FIG. 19), and wheels 312 (FIGS. 14-17).

The screening device can also comprise an elongate trim member 350 (FIGS. 14 and 16) attached to the top panel retaining member 20" or to the bottom panel retaining member in a fashion similar that used with the top panel retaining member 20". Trim member 350 has formed on its back side 354 an upper downward open channel 352 and a lower upward open channel 360 with these channels engaging and sliding along an upward projection 366 and a downward projection 368 on the top panel retaining member 20" or the bottom panel retaining member that engage the upper channel 352 and lower channel 360 of trim member 350. A recess 370 in a side 372 of top panel retaining member 20" or the bottom panel retaining member is of sufficient size and depth to accept a fastener head 376. As a result, the fastener head is covered by trim member 350 with reduced exposure to corroding environmental elements.

In certain situations, such as when a panel rolling member assembly 310 comprises a roller 318 as shown in FIG. 19, the top panel retaining member 20" or 20' (FIG. 14 or 12) and the bottom panel retaining member 30'" are spaced from each other so as to prevent removal of panels 40 by moving the panels upward into the upper channels 22" and 24" (FIG. 14) or 22' and 24' (FIG. 12) and swinging a lower edge of the panels away from the lower channels 32'" and 34'". Typically the panel rolling member assembly 310 inherently does not allow such movement, e.g., FIGS. 14-18.

The foregoing and other objects, features and advantages of the invention will become apparent from the following disclosure in which one or more preferred embodiments of the invention are described in detail and illustrated in the accompanying drawings. It is contemplated that variations in procedures, structural features and arrangement of parts may appear to a person skilled in the art without departing from the scope of or sacrificing any of the advantages of the invention.

Figure 1:
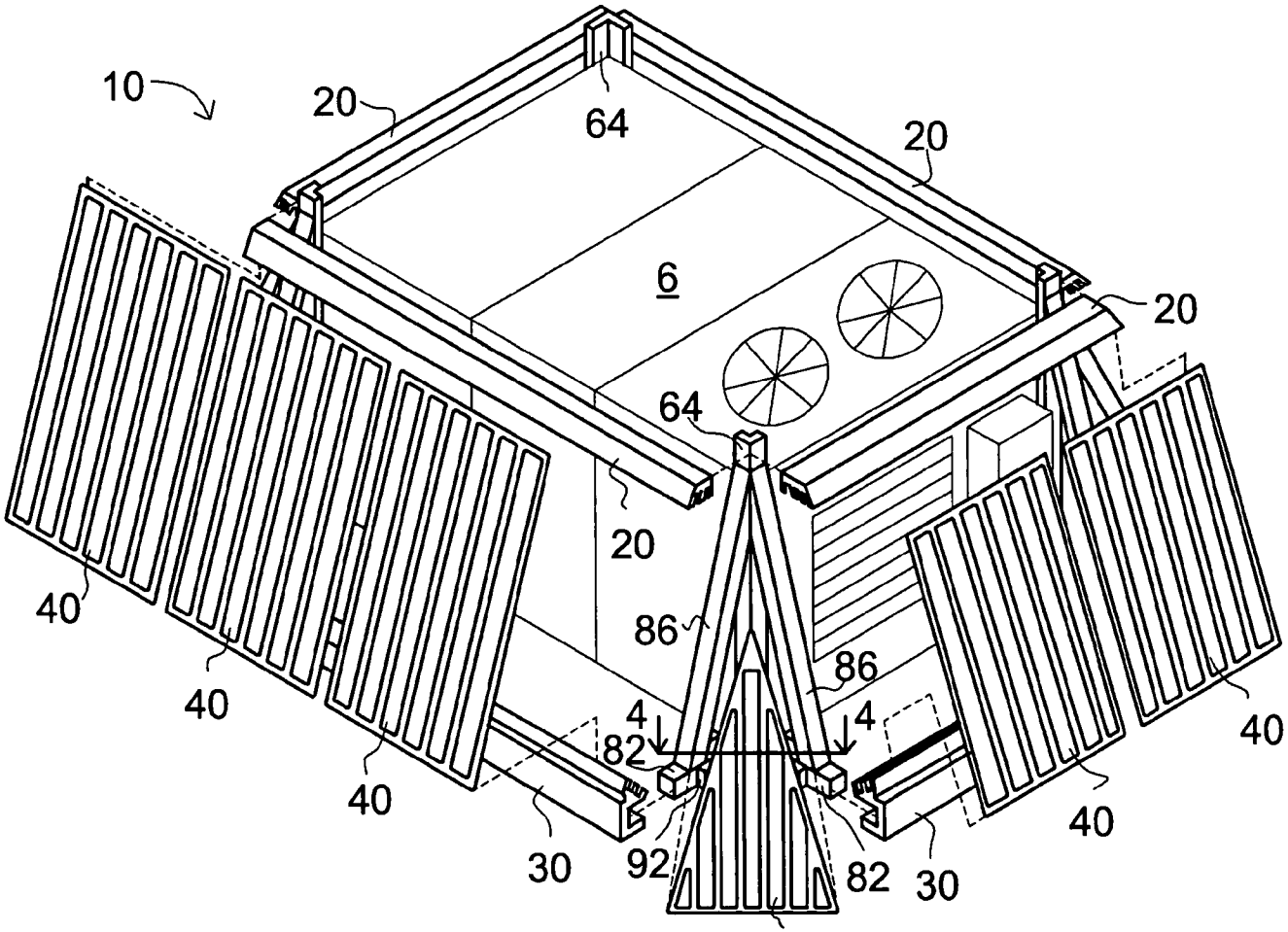
FIG. 1 is an exploded perspective view of the screening device of the present invention illustrating the major components of the system as used with a device such as an air conditioning unit including the upper and lower elongate members (upper and lower panel retaining members), rectangular sheets (panels), corner sheet (panel), and supporting frame structure.

In describing the preferred embodiment of the invention which is illustrated in the drawings, specific terminology is resorted to for the sake of clarity. However, it is not intended that the invention be limited to the specific terms so selected and it is to be understood that each specific term includes all technical equivalents that operate in a similar manner to accomplish a similar purpose.

Although a preferred embodiment of the invention has been herein described, it is understood that various changes and modifications in the illustrated and described structure can be affected without departure from the basic principles that underlie the invention. Changes and modifications of this type are therefore deemed to be circumscribed by the spirit and scope of the invention except as the same may be necessarily modified by the appended claims or reasonable equivalents thereof.

DETAILED DESCRIPTION OF THE INVENTION AND BEST MODE FOR CARRYING OUT THE PREFERRED EMBODIMENT

Sliding Panel Configuration

As shown initially if FIG. 1, the present invention is a screening device generally designated by the numeral 10 that is used to improve the appearance of large outdoor equipment 6 such as heating, ventilating, and air conditioning equipment. In its basic form, the invention comprises a top elongate panel retaining member 20, a bottom panel retaining member 30, sheets 40 with parallel opposite edges, and end caps 50 (shown in FIG. 4) that prevent the sheets 40 from being removed from the panel retaining members 20 and 30.

Figure 2:
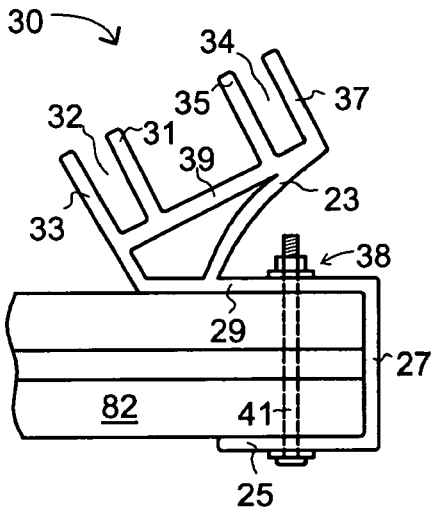
FIG. 2 is an end view of the bottom panel retainer mounted to a horizontal extrusion member.

As shown in FIG. 1 and in further detail in FIG. 2, the bottom panel retainer 30 is comprised of two, spaced-apart, upward directed, U-shaped channels 32 and 34 which receive the lower edges of panels 40. The U-shaped channels 32, 34 are spaced apart sufficiently so that panels 40, which are typically ribbed for structural strength, may slidably move past each other when the lower edge of separate panels 40 are placed in channels 32, 34. Typically and as shown in FIG. 2, the bottom panel retaining member 30 is an extruded member formed with an angled base 39 and orthogonal upward projecting fingers 31, 33, 35, and 37. Finger sets 31, 33 and 35, 37 along with a portion of angled base 39 form U-shaped channels 32 and 34. Base 39 is attached to finger 33 which is an upwardly angled portion of horizontal C-section member 29. Although not essential and other configurations are possible, a rib 23 is used to provide structural rigidity and to support the base 39 of the U-shaped channels 32, 34. The C-section portion of extrusion 30 is formed from contiguous orthogonal members 25, 27, and 29 and is sized to engage the end of horizontal member 82. After engagement of the C-section portion of bottom panel retainer 30 to horizontal member 82, it is secured to horizontal member 82 by means of suitable fastener such a machine screws, tapping screws or nuts and bolts. For example, a nut and bolt assembly 38 may be used in a vertical hole formed in C-section portions 25, 29 and the end of horizontal member 82. Typically both end portions of bottom retaining member 30 are engaged to the ends of horizontal members 82. However, when the length of the bottom retaining member is particularly long, additional horizontal members 82 may be used along the length of bottom panel retainer 30. Although screw-type fasteners are typically used to secure the bottom retainer panel 30, a quick release, clevis-type pin may also be used to secure panel retainer 30 to horizontal members 82. Such quick-release pins enable the quick and easy removal of the bottom panel retainer 30, when unencumbered access to the underlying machinery 6 is frequently required.

As noted, separate panels 40 are mounted in the two U-shaped channels 32 and 34 to allow the panels to slide past each other in channels 32, 34. For ribbed panels 40, the spacing between channels 32 and 34 is considerable to allow for unobstructed passage of the panels 40 behind or in front of each other. As such, separate fingers 31 and 35 have considerable separation between them. However, it is to be realized that fingers 31 and 35 may be formed as a single central finger when the clearance separation between panels 40 is sufficiently small.

Figure 3:
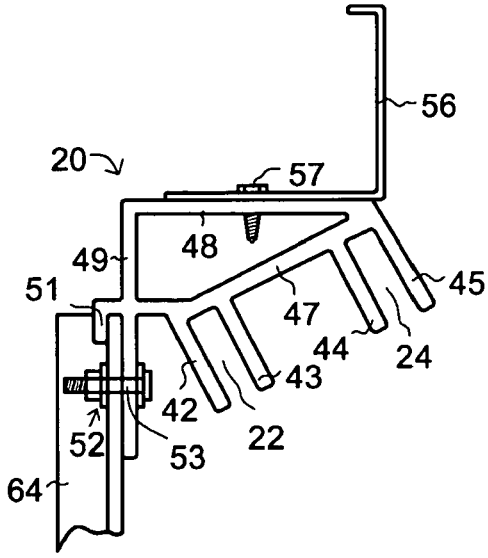
FIG. 3 is an end view of the top panel retainer mounted to a vertical corner member along with an upper trim member.

Similarly and as shown in FIGS. 1 and 3, the top panel retainer 20 is also formed with two, spaced-apart, downward directed, U-shaped channels 22 and 24 which receive the upper edges of panels 40. As with the bottom panel retainer 30, the upper U-shaped channels are spaced apart sufficiently to allow panels 40 mounted in channels 22 and 24 to slide past each other. Preferably the top panel retainer 20 is an extrusion formed from a horizontal top section 48 and a vertical section 49 orthogonally joined at their ends. An angled top member 47 is joined to the opposite end of top section 48 and to the vertical section 49. Fingers 42, 43, 44, and 45 project downward orthogonally from top member 47 to form channels 22 and 24 that receive the upper edges of panels 40. Channels 22 and 24 are spaced sufficiently far apart so as to allow panels 40 to pass in front of or behind each other. Fingers 43 and 44 may be formed as a single finger. An optional tang 51 projects outward from vertical section 49 and then orthogonally downward. The channel formed between tang 51 and vertical section 49 receives the upper edge of corner member 64 and allows for rapid positioning of the top panel retainer with respect to corner member 64. The top panel retainer 20 is attached at each end to corner member 64 with a suitable fastener such as a nut and bolt assembly 52 (FIG. 3). When top panel retainer 20 is particularly long, additional pieces of flat members may be used along the length of retainer 20 (not shown).

The bottom panel retainer 30 and the upper panel retainer 20 are spaced apart from each other so as to securely hold the panels 40 in place. That is, panels 40 cannot be removed from the U-shaped channels 22, 24, 32, 34 by moving the panels upward in channels 22 or 24 and swinging the lower edge of panel 40 from channel 32 or 34. In effect the spacing between the bottom panel retainer 30 and the upper panel retainer 20 is such that panels 40 can only be loaded and removed from the open ends of channels 22, 24, 32, and 34.

When end caps 50 are secured to both ends of bottom panel retainer 30 and upper panel retainer 20, panels 40 are securely retained within the channels 22, 24, 32, and 34 and are incapable of being removed from the channels. Although end cap 50 is typically formed as a single piece that covers the ends of bottom panel retainer 30 and upper panel retainer 20, it is to be realized that end cap 50 can be comprised of two or more members that block the ends of channels 22, 24, 32, and 34 and retain panels 40 within these channels. End caps 50, shown in FIG. 4 in cross section, extend along and are fastened to vertical angular support members 86 to close the channel ends of both the upper retainer 20 and lower panel retainer 30. Although only shown with regard to the channel ends of channels 32, 34 of lower panel retainer 30, it is to be realized that the upper portion of single end cap piece 50 also closes the ends of the channels 22, 24 of the upper panel retainer 20.

Figure 4:
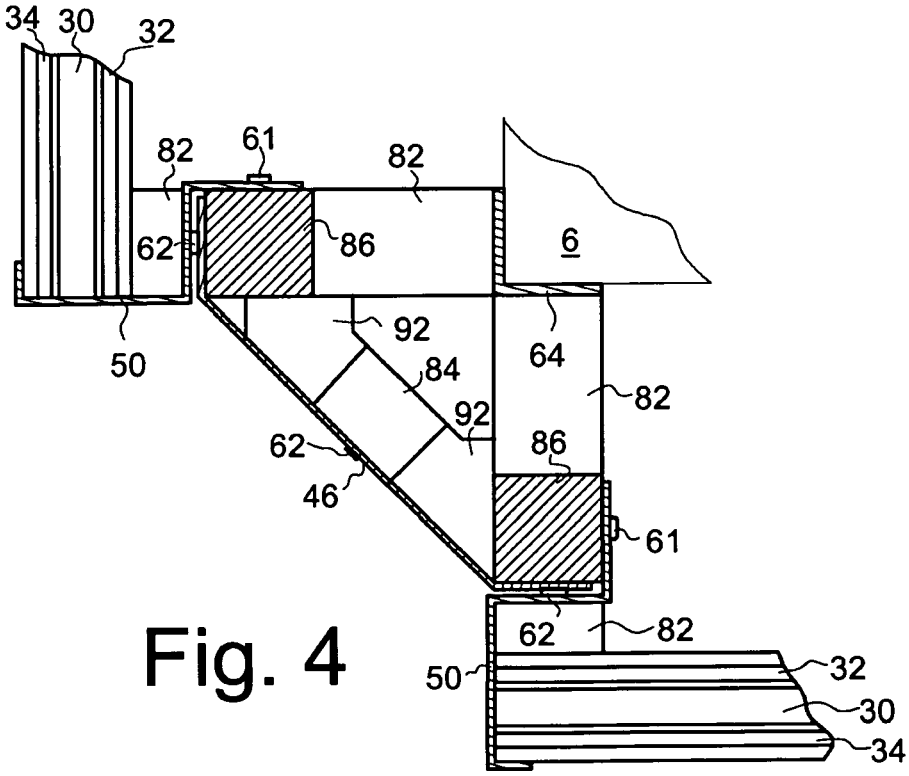
FIG. 4 is a top cross-sectional view along line 4-4 of FIG. 1 illustrating the positioning of end caps at the ends of the bottom panel retainers and the attachment of the end caps to the angular vertical support member so as to conceal the fasteners used to secure the end caps and the corner sheet to the vertical angular support members.
Figure 5:
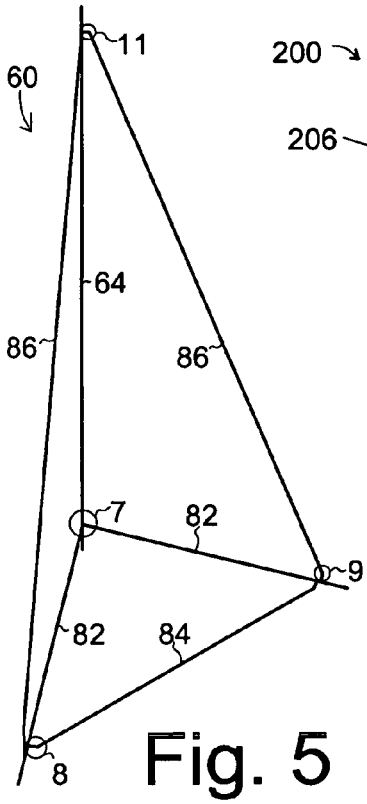
FIG. 5 is a schematic perspective view of the corner framing structure illustrating the location of the angular castings (indicated by numbered circles) used to fasten the various framing members into a corner framing structure.
Figure 7:
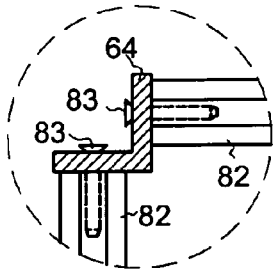
FIG. 7 is a detailed partial top view of the circled portion 7 of FIG. 5 illustrating the fastening assembly used to attach the ends of the horizontal extrusion members to the vertical corner member.
Figure 11:
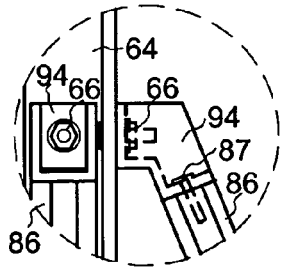
FIG. 11 is a detailed partial plan view of the circled portion 11 of FIG. 5 illustrating the attachment of the vertical angular support extrusion member to the vertical corner member using a third angular casting.

With reference to FIGS. 4, 5 and 7, and initially FIG. 7, the ends of two horizontal members 82 are attached to vertical corner member 64 using a suitable faster such as a bolt or metal screw 83. The ends of bottom retainer channel 30 are attached to the opposite second ends of horizontal members 82 by means of suitable fasteners such as the nut and bolt assembly 38 illustrated in FIG. 2. As further illustrated in FIGS. 4, 5, and 8, a horizontal corner member 84 is also attached near the second ends of horizontal members 82 by means of angular castings 92. The lower ends of vertical support members 86 are also attached near the second ends of horizontal members 82 and at their top to the upper portion of vertical corner member 64 as shown in FIG. 1. FIGS. 5 and 11 illustrate the use of second angular castings 94 to attach the vertical angular support members 86 to the vertical corner member 64 while FIGS. 5 and 9 further illustrate the use of third angular casting 96 to attach the lower ends of vertical angular support member 86 to horizontal extrusion member 82.

Referring to FIG. 4, the vertical edges of corner sheet 46 are bent at an angle for attachment to vertical angular support members 86 by means of fasteners such as metal screws 62. Similarly the base edge of corner sheet 46 is bent for attachment to horizontal corner member 84 with screws 62. After the corner sheet 46 has been secured to the vertical and corner support members 82, 84, the corner cap 50 is placed over the ends of the top and bottom panel retainers 20 and 30. Only the capping of the channels 32, 34 of bottom panel retainer 30 is illustrated in FIG. 4, it being realized that a single end cap 50 extends upward along vertical angular support member 86 to also cap the channels 22, 24 of top panel retainer 20. As shown in FIG. 4, end cap 50 is bent at right angles around two sides of vertical support member 86 and is attached to vertical support member 86 on the inside of the vertical support member 86, it being realized that one of the rectangular sheets 40 is slid out of the way in upper and lower channel pairs 24, 34 or 22, 32 during the attaching process. Such an end capping means has the advantage of concealing all fasteners from view and lessens the possibility of unwanted removal.

Figure 12:
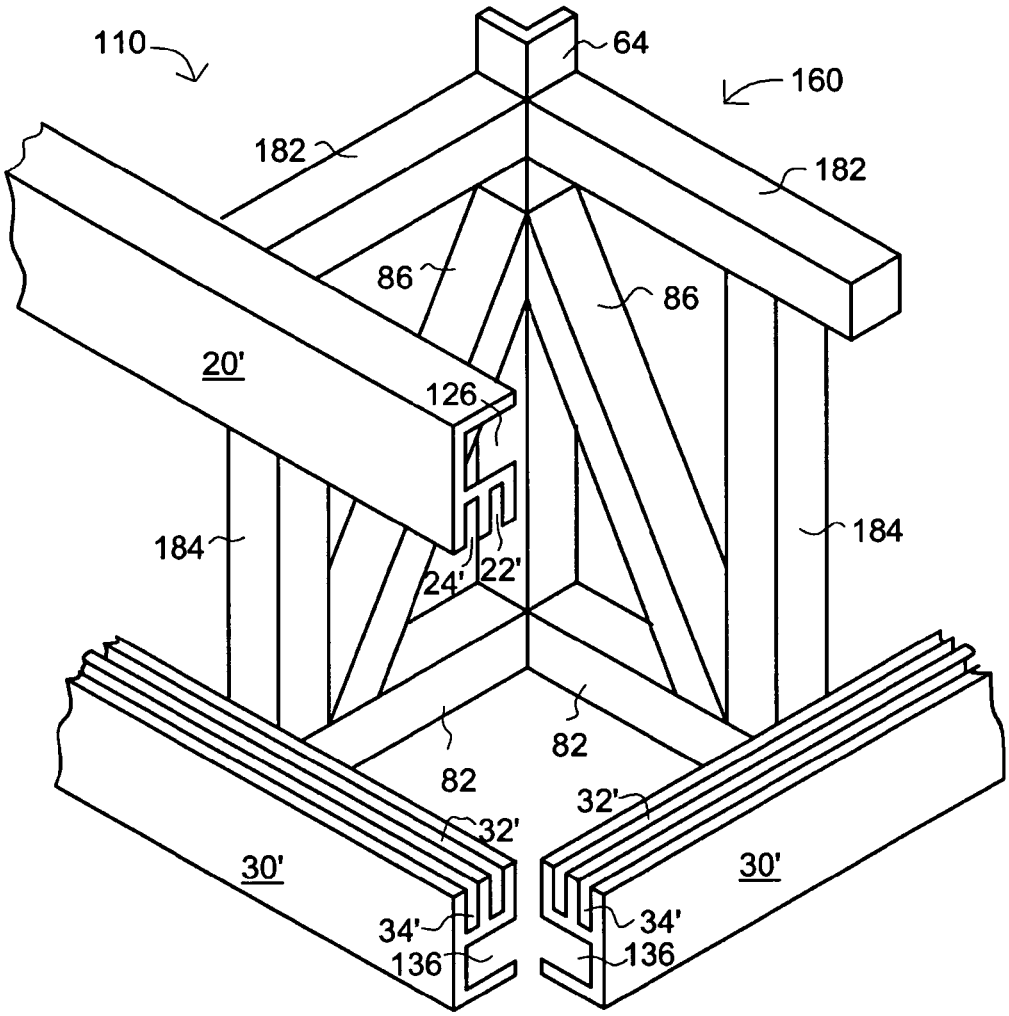
FIG. 12 is a partial perspective drawing of a second embodiment of the invention illustrating the use of vertical upper and lower panel retention members with the upper retention member being supported by additional upper horizontal extrusion members in the supporting structure.

As shown especially in FIGS. 1-3, the upper and lower panel retainers 20 and 30 are formed in such a fashion as to position the panels 40 at an angle to vertical, that is, the panels 40 slope downward away from the device being covered, i.e., a canted configuration. FIG. 12 is a partial perspective view illustrating upper and lower panel retainers 20' and 30' that allow for vertical mounting of panels 40. As illustrated, spaced-apart U-shaped channels 22', 24', 32' and 34' are open so as to provide a vertical panel orientation.

Figure 6:
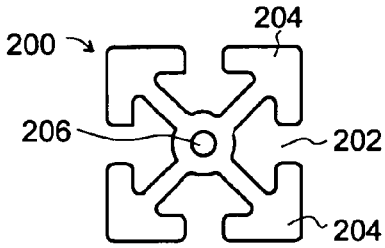
FIG. 6 is an end view of a framing extrusion used in the manufacture of the various frame support members.
Figure 10:
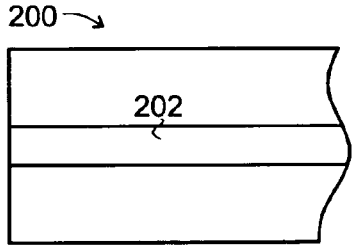
FIG. 10 is a partial plan view of the framing extrusion illustrated in FIG. 5 and used in the manufacture of the various frame support members.

As seen in FIGS. 1 and 4, the top and bottom panel retainers 20 and 30, panels 40, corner panels 46, and end caps 50 (FIG. 4), are supported by means of a supporting structure 60 (FIG. 5) comprised of vertical corner member 64, horizontal extrusion members 82, horizontal corner extrusion member 84, and vertical angular support extrusion members 86. A typical extrusion member 200 is shown in FIGS. 6 and 10 and comprises a central tube in which is formed center bore 206. Exterior corner arms 204 form a partially covered groove 202 on each side of the square-shaped extrusion 200. Angular castings 92, 94, and 96 are shown in FIGS. 4, 5, 8, 9, and 11 and are used to join extrusion members 82, 84, and 86 to each other and to vertical corner member 64.

Referring to FIG. 7 (a top cross-section view of corner assembly 7 in FIG. 5), two horizontal extrusions 82 are attached at right angles to each other by attaching their ends to vertical corner member 64. The horizontal extrusions 82 are attached by screws 83 that pass through the orthogonal portions of corner member 64 into the center cylindrical bore 206 (FIG. 6) of the horizontal extrusion 82.

Figure 9:
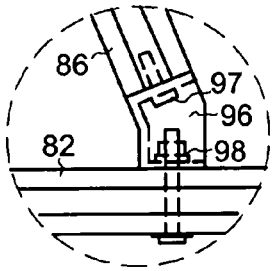
FIG. 9 is a detailed partial plan view of the circled portion 9 of FIG. 5 illustrating the attachment of the angular support extrusion member to the horizontal extrusion member using a second angular casting.

As shown in FIG. 9, a vertical angular support extrusion member 86 is attached at one end to horizontal extrusion member 82 by means of angular casting 96. One end of angular casting 96 is attached to the angular support extrusion member 86 by means of a screw 97 driven into the bore 200 (FIG. 6) of extrusion 86. The other end of angular casting 96 is attached to horizontal extrusion member 82 by means of a nut and bolt assembly 98 passing through a hole drilled into horizontal extrusion member 82. As shown in FIG. 11, the opposite end of angular extrusion 86 is attached to the vertical corner member 64 by means of second angular casting 94. One end of casting 94 is attached to the vertical corner member 64 by means of nut and bolt assembly 66 while the other end of casting 94 is secured to the upper end of vertical angular extrusion 86 by means of a screw 87 that passes through a hole in casting 94 and then is screwed into the bore 200 (FIG. 6) of angular extrusion 86.

Figure 8:
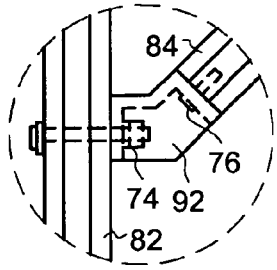
FIG. 8 is a detailed partial top view of the circled portion 8 of FIG. 5 illustrating the attachment of the angled horizontal corner extrusion member to the horizontal extrusion member using a first angular casting.

As shown in FIG. 8, the horizontal corner extrusion member 84 is fastened to the horizontal extrusion member 82 by means of first angular casting 92. One end of angular casting 92 is attached to horizontal extrusion member 82 by means of nut and bolt assembly 74 while the other end of casting 92 is attached to corner extrusion member 84 by means of a screw 76 passing through a hole in the end of casting 92 and screwed into the bore 200 (FIG. 6) of extrusion member 84. The opposite end of extrusion member 84 is similarly attached to a second horizontal member 82 using a second corner casting 92 (FIG. 5).

Referring to FIGS. 1 and 4, the vertical corner member 64 is attached to the screened device 6 by means of screws or other suitable securing means. Preferably the vertical corner member 64 extends slightly above the screened device 6 to enable easy attachment of top panel retainer 20 (FIG. 3) by means of nut and bolt assembly 52. An engagement tang 51 allows for quick alignment and positioning of retainer 20 during the attaching process. As seen in FIG. 2, the bottom panel retainer 30 is attached to the horizontal extrusion members 82 by means of a C-shaped channel formed by retainer 20 members 25, 27, and 29 that accepts the end of horizontal extrusion member 82 and is secured to the extrusion member 82 by means of nut and bolt assembly 38. Alternatively and as shown in U.S. Pat. No. 5,664,384, all of which is incorporated herein as if completely written herein, the screening device 10 may be attached to free standing posts or other alternative anchoring devices.

To complete the screening device 10, a corner panel 46 (FIGS. 1 and 4) is attached to vertical angular corner support extrusion members 86 and horizontal corner extrusion 84, typically with suitable fasteners such as screws 62. The corner panel 46 is attached under a side wall of end caps 50 (FIG. 4) to allow removal and replacement of the end caps 50 in the event one or more of the panels 40 require replacement. Although panels 40 are typically made of plastic or light weight metal such as aluminum, fabric may be used, especially fabric onto which aesthetically pleasing company logos and other indicia may be imprinted.

Figure 13:
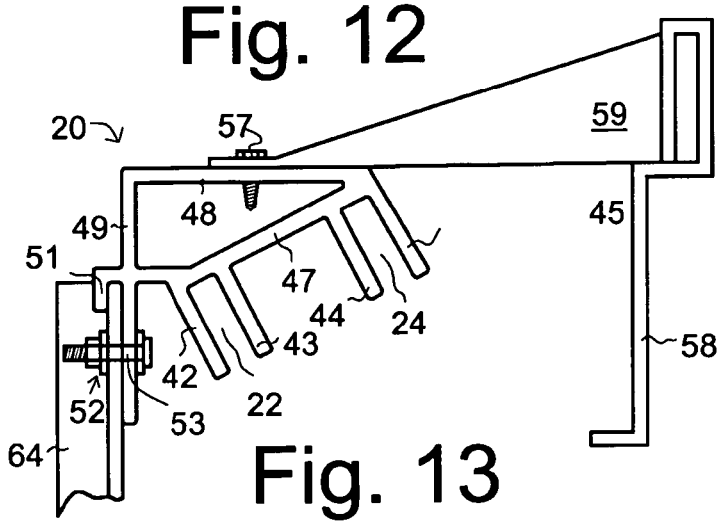
FIG. 13 is an end view of an alternate embodiment of an upper, double-step, elongate trim member attached to the top panel retainer using attachment brackets.

The screening device 10 is typically completed by attaching an upper trim panel 56 (FIG. 3) directly to the top panel retainer 20. Alternatively and as shown in FIG. 13, a double-step, upper trim panel 58 may be mounted outward from the top panel retainer 20 by means of attaching members such as attachment brackets 59 which are mounted to the top of retainer 20 with suitable fasteners such as sheet metal screws 57.

FIG. 12 illustrates an alternative embodiment 110 of the present invention in which the top panel retainer 20' and the bottom panel retainer 30' are formed with spaced-apart U-channels 22', 24', 32', and 34' that have a vertical orientation to afford vertically aligned panels rather than the canted alignment of embodiment 10. The supporting structure 160 is identical to that used with the canted orientation except that it further comprises two upper horizontal extruded members 182 fastened at right angles to each other with one end attached to the vertical corner member 64 in a fashion similar to the attachment of the lower horizontal members 82 as shown in FIG. 7. Vertical extrusion members 184 are attached directly to the upper horizontal extrusion members 182 and the lower horizontal extrusion members 82 by means of a screw passing through a hole formed and passing through extrusion members 182 and 82 and through which a screw is threaded into the center bore 200 (FIG. 5) of the vertical extrusion member 184. The top panel retainer 20' and the lower panel retainer 30' are attached to the ends of the horizontal extrusion members 82 and 182 by means of C-section channels 126 and 136 into which the ends of the horizontal extrusion members 82 and 182 are inserted and secured with suitable fastening devices.

Rolling Panel Configuration

Figure 14:
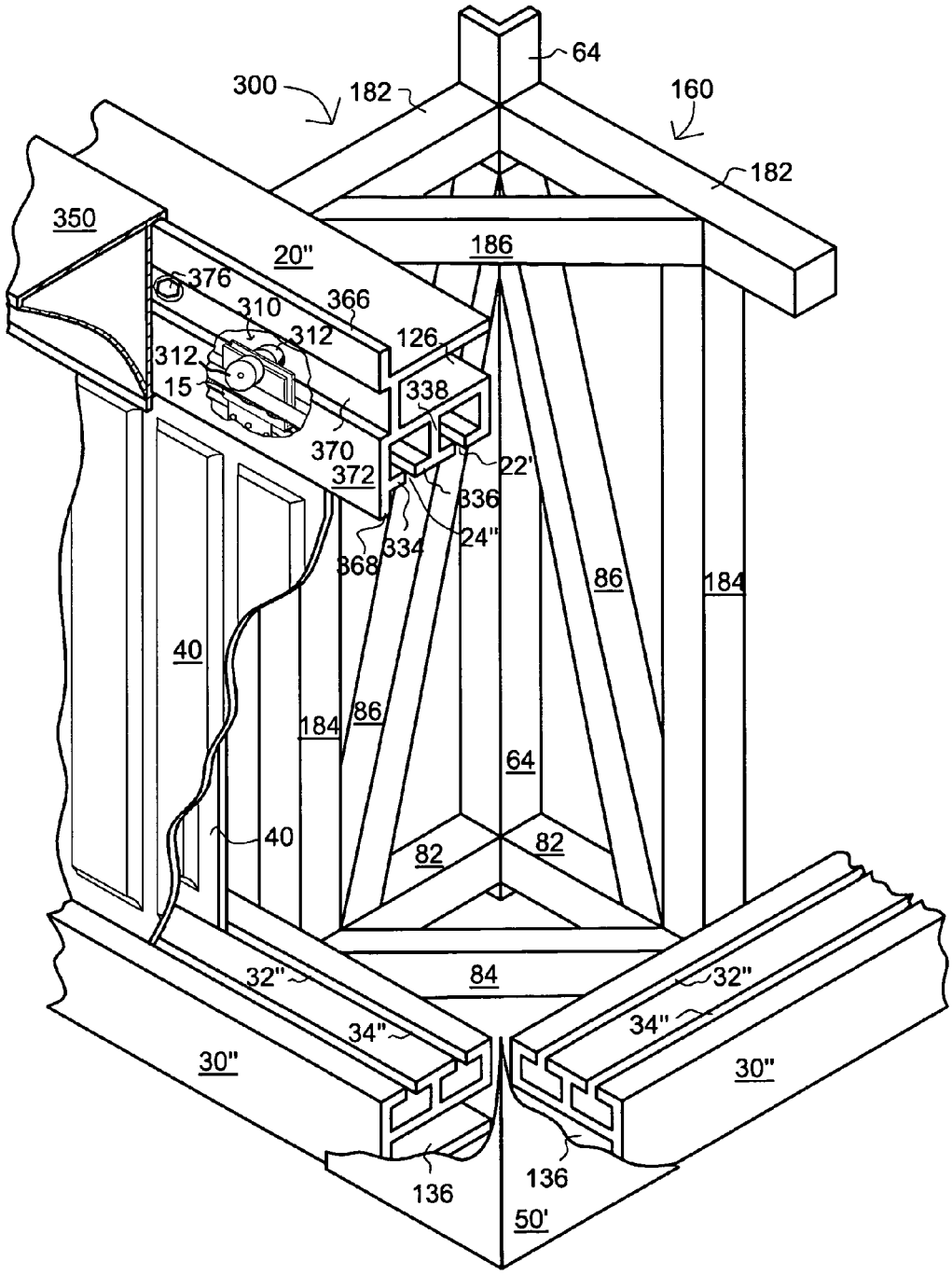
FIG. 14 is a cut-away partial perspective and cross-sectional drawing of a third embodiment of the invention illustrating the use of a panel rolling member that is attached to a panel and that allows the panels to roll in the upper channels of the top panel retaining member as well as a trim member (shown in cross section) that is easily attached to the top panel retaining member by means of mating flanges on the panel retaining member and channels formed in the trim member.

As discussed above, FIG. 1, is a screening device generally designated by the numeral 10 that is used to improve the appearance of large outdoor equipment 6 such as heating, ventilating, and air conditioning equipment. In its basic form, the invention comprises a top elongate panel retaining member 20, a bottom panel retaining member 30, panels (sheets) 40 with parallel opposite edges, and end caps 50 (shown in FIG. 4) that prevent the sheets 40 from being removed from the panel retaining members 20 and 30. FIG. 12 illustrates the principal components of a vertical panel configuration. In the embodiment shown in FIG. 14 and designated generally by the numeral 300, similar parts have similar numbers to those previously used with primes being used to designate slightly different component configurations. FIG. 14 illustrates a vertical panel orientation similar to the structure of FIG. 12.

As seen in FIG. 14, the underlying support structure comprises a corner supporting structure 160 further comprising: 1) a vertical corner member 64, 2) two lower horizontal members 82, each with first and second ends, and attached at right angles to each other at their first ends to a lower portion of vertical corner member 64, 3) two vertical angular support members 86, each with first and second ends, with the vertical angular support members 86 attached at their lower first ends to the second end portions of the horizontal members 82 and at their upper ends to an upper portion of the vertical corner member 64, and 4) a horizontal corner member 84 attached at its ends to the second end portions of horizontal members 82. The overall configuration is shown in FIG. 5. Various methods for attaching the various members may be used including welding, brazing or through the use of suitable fasteners such as the angular castings 92, 94 and 96 as shown in FIGS. 8, 9 and 11 especially when used in conjunction with the framing extrusions 200 shown in FIGS. 6 and 10.

When a canted panel assembly is desired such as shown in FIG. 1, the upper panel retaining member 20 is attached directed to corner member 64. When an upright panel assembly is used such as shown in FIG. 14, two upper horizontal members 182, each with first and second ends, are attached at right angles to each other at their first ends to an upper portion of the vertical corner member 64. For additional strength and stability, vertical members 184 are attached to the second end portions of the upper and lower horizontal members 182 and 82, respectively. In additional, an upper horizontal corner member may also be used.

At least two panels 40, i.e., sheet material, each having a pair of parallel opposite edges, are held at a predetermined location by a framework comprising: 1) an upper rigid elongate channel containing top panel retaining member 20" held in an upper lengthwise horizontal position with at least two, spaced-apart upper channels facing substantially downward, and 2) a lower rigid elongate substantially channel shaped bottom panel retaining member 30" held in a lower lengthwise horizontal position with at least two, spaced-apart lower channels 32", 34" being parallel to, and facing substantially upward toward top panel retaining member 20". The top panel retaining member 20" and the bottom panel retaining member 30" are spaced from each other so as to prevent removal of panels 40 by moving panels 40 upward toward or into the upper channels 22" or 24" and swinging a lower edge of panels 40 away from lower channels 32" or 34". The upper channels 22" and 24" and the lower channels 32" and 34" are spaced-apart sufficiently from each other to allow for unobstructed passage of panels 40 with respect to each other with lateral movement of the panels 40. One or more end caps 50 are positioned over the ends of at least one of 1) the spaced-apart upper channels 22" and 24", and 2) the spaced-apart lower channels 32" and 34" to prevent the panels 40 from being removed from the upper channels 22" or 24" and the lower channels 32" or 34" by lateral movement of the panels in the upper and lower channels.

Figure 18:
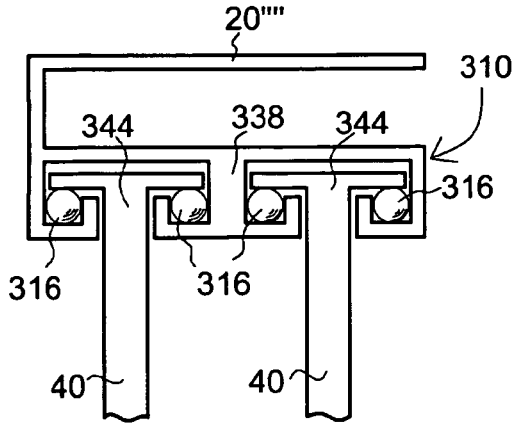
FIG. 18 is another embodiment of the panel rolling member that utilizes rolling balls or ball bearings on which a panel T-member rolls.
Figure 19:
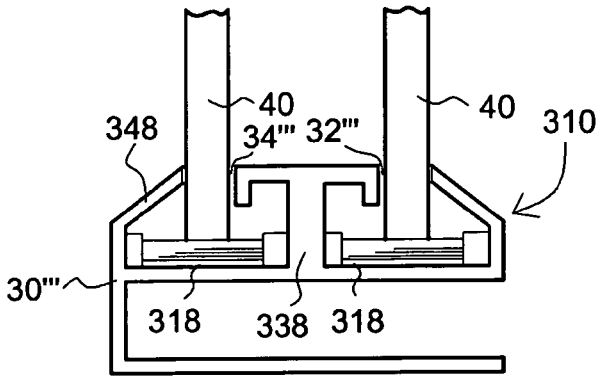
FIG. 19 is another embodiment of the panel rolling member that utilizes rollers or roller bearings on which the lower edge of the panel rolls.

A panel rolling member assembly 310 allows the panels 40 to roll in either the upper channels 22", 24" or lower channels 32", 34". The panel rolling member assembly can be attached to panel 40 or it can be attached to or contained in the top panel retaining member 20'" (FIG. 17) or 20" (FIG. 18) or said bottom panel retaining member 30'" (FIG. 19). The panel rolling member assembly 310 can have rolling members such as balls 316 (FIG. 18), rollers 318 (FIG. 19) and wheels 312 (FIGS. 14-17).

Figure 15:
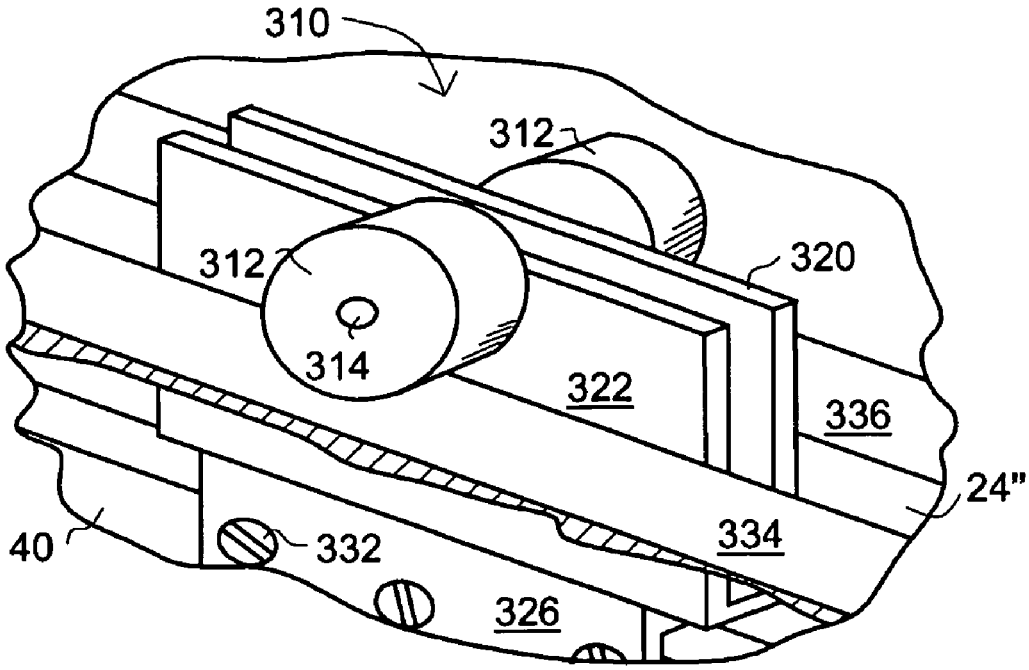
FIG. 15 is an enlarged view of cut-away 15 in FIG. 14 further illustrating the configuration of the panel rolling member.
Figure 16:
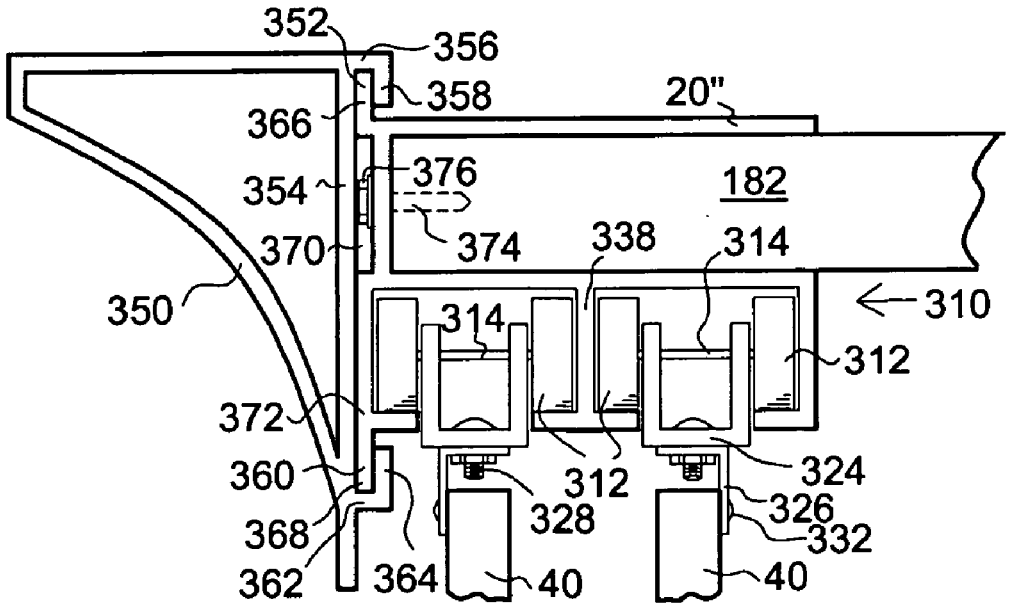
FIG. 16 is an end view of the top panel retaining member and trim member illustrating the use of panel retaining member flanges and channels in the trim member to attach the trim member to the top panel retaining member as well as illustrating further the panel rolling member and its attachment to a panel.

FIGS. 14-16 illustrate the use of a panel rolling member assembly 310 using wheels 312. A U-shaped carriage 320 travels in channel 24". Two wheels 312 are mounted on an axle 314 passing through the walls 322 of the carriage 320. One side of a right-angled bracket 326 is fastened to the bottom of the carriage 324 with a suitable fastener such as nut and bolt 328. The other side of the right-angled bracket 326 is fastened to panel 40 with appropriate fasteners 332. The wheels roll along on top of inward pointing ledges 334, 336 projecting from the outer side 372 and center post 338 of top panel retaining member 20".

Figure 17:
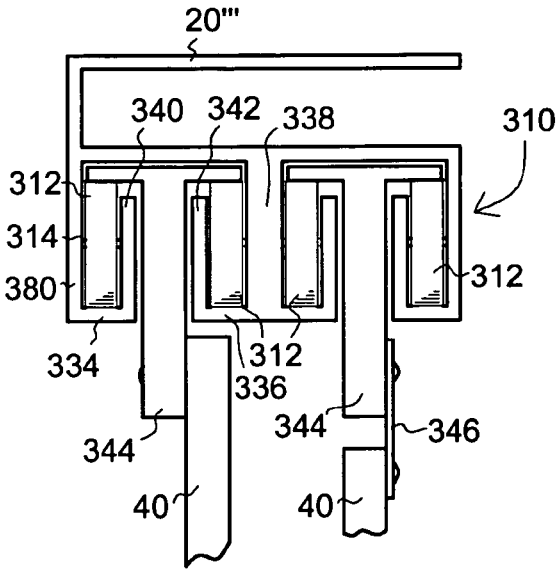
FIG. 17 is another embodiment of the panel rolling member that is attached to the top panel retaining member.

FIG. 17 illustrates a panel roller member assembly in which wheels are mounted in top panel retaining member 20'. Outside wall 380, ledge 334, and upward directed side 340 form an upward oriented channel in which wheel 312 is mounted with axle 314 to the outside wall 380 and upward directed side 340. Similarly, a second upward oriented channel is formed from center post 338, ledge 336, and upward directed side 342. Wheel 312 is mounted with axle 314 to the center post 338 and upward directed side 342. The lower end portion of T-bar 344 is attached directly to panel 40 or by means of attaching strip 346. The T portion of T-bar 344 rolls on opposite wheels 312, it being understood that a number of wheels are positioned along the length of top panel retaining member 20'''. FIG. 18 is similar except that balls 316 are used instead of wheels 312. Also, the T-bar 344 is formed as an integral part of panel 40.

FIG. 19 shows a panel roller member assembly in which rollers 318 are placed along the length of bottom panel retaining member 30''' and the bottom of panel 40 rolls on rollers 318. The top of panel 40 is contained in downward directed channels such as channels 22' and 24' formed in top panel retaining member 20' shown in FIG. 12. The upper side portion slants upward and inward toward panel 40 in forming channel 34'' in order to deflect dirt and debris from rollers 318.

FIGS. 14 and 16 illustrate a method for attaching an elongate trim member 350 to either the top panel retaining member 20'' or the bottom panel retaining member. As best seen in FIG. 16, trim member 350 has formed on its back side an upper downwardly open channel 352 formed from the upper rear portion 354 of elongate trim member 350, an outwardly directed portion 356 and downwardly directed portion 358. Similarly, a lower, upward directed channel 360 is formed from a lower rear portion 354 of elongate trim member 350, an outwardly directed portion 362 and upwardly directed portion 364. Downward directed channel 352 and upward directed channel 360 engage and slide along an upward projection 366 and a downward projection 368 on said top panel retaining member 20''. A recess formed in the side wall 372 of the top panel retaining member 20'' allows the top panel retaining member 20'' to be attached to the end of upper horizontal member 182 with a bolt fastener 374 with the bolt fastener head 376 within the confines of recess 370 allowing the rear portion of elongate trim member 350 to contact side wall 372 of the top panel retaining member 20'' thereby protecting fastener 374 from weathering and corroding elements.

It is possible that changes in configurations to other than those shown could be used but that which is shown is preferred and typical. Without departing from the spirit of this invention, various means of fastening the components together may be used. It is therefore understood that although the present invention has been specifically disclosed with the preferred embodiment and examples, modifications to the design concerning sizing, shape, attachment, structural reinforcement and application of various roller assembly components and trim members to both upper and lower panel retaining members will be apparent to those skilled in the art and such modifications and variations are considered to be equivalent to and within the scope of the disclosed invention and the appended claims.

What is claimed is:

1. A screening device comprising:

a) at least two panels, each having a pair of parallel opposite edges;

b) a panel assembly that holds said panels at a predetermined location;

c) said panel assembly comprising a framework including:

1) an upper rigid elongate substantially channel shaped top panel retaining member held in an upper lengthwise horizontal position with at least two, spaced-apart upper channels facing substantially downward;

2) a lower rigid elongate substantially channel shaped bottom panel retaining member held in a lower lengthwise horizontal position with at least two, spaced-apart lower channels being parallel to, and facing substantially upward toward said top panel retaining member;

3) said upper channels spaced apart sufficiently from each other and said lower channels spaced apart sufficiently from each other to allow for unobstructed passage of said panels with respect to each other on lateral movement of said panels in said spaced-apart upper and lower channels; and 4) end caps positioned over the ends of at least one of 1) said spaced-apart upper channels and 2) said spaced-apart lower channels to prevent said panels from being removed from said upper channels and said lower channels by lateral movement of said panels in said upper and lower channels;

d) a corner supporting structure with said corner supporting structure further comprising:

1) a vertical corner member;

2) two lower horizontal members, each with first and second ends, with said horizontal members attached at right angles to each other at their first end portions to a lower portion of said vertical corner member;

3) two vertical angular support members, each with first and second ends, with said vertical angular support members attached at their lower first end portions to said second end portions of said horizontal members and at their upper end portions to an upper portion of said vertical corner member; and 4) a horizontal corner member attached at its end portions to said second end portions of said two horizontal members; and e) a panel rolling member assembly allowing said panels to roll in said upper channels of said top panel retaining member or in said lower channels of said lower panel retaining member.

2. The screening device according to claim 1 further comprising two upper horizontal members, each with first and second end portions, with said horizontal members attached at right angles to each other at their first end portions to an upper portion of said vertical corner member.

3. The screening device according to claim 2 wherein said top panel retaining member is attached to one of said two upper horizontal members and said bottom panel retaining member is attached to one of said two lower horizontal members.

4. The screening device according to claim 2 further comprising a horizontal corner member attached to said second end portions of said two upper horizontal members.

5. The screening device according to claim 2 further comprising a vertical member attached to said second end portion of one of said two upper horizontal members and to said second end portion of one of said two lower horizontal members.

6. The screening device according to claim 1 with said top panel retaining member and said bottom panel retaining member being spaced from each other so as to prevent removal of said panels by moving said panels upward toward or in said upper channels and swinging a lower edge of said panels away from said lower channels.

7. The screening device according to claim 1 wherein said panel rolling member assembly is attached to said panel.

8. The screening device according to claim 1 wherein said panel rolling member assembly is attached to said top panel retaining member or said bottom panel retaining member.

9. The screening device according to claim 1 wherein said panel rolling member assembly comprises a rolling member selected from the group of rolling members consisting of balls, rollers, and wheels.

10. The screening device according to claim 9 wherein said rolling member is a wheel.

11. The screening device according to claim 10 wherein said wheel is attached to said panel.

12. The screening device according to claim 10 wherein said wheel is attached to said top panel retaining member.

13. The screening device according to claim 1 further comprising an elongate trim member attached to said top panel retaining member or said bottom panel retaining member.

14. The screening device according to claim 13 wherein said trim member has formed on its back side an upper downward open channel and a lower upward open channel, said channels engaging and sliding along an upward projection and a downward projection on said top panel retaining member or said bottom panel retaining member that engage said upper channel and said lower channel of said trim member.

15. The screening device according to claim 1 further comprising a recess in a side of said top panel retaining member or said bottom panel retaining member of sufficient size and depth to accept a fastener head.

16. The screening device according to claim 1 wherein the upper and outer side portion of said lower channel slants upward and inward toward said panels.

* * * * *